US006473572B1

(12) United States Patent
Uchiyama et al.

(10) Patent No.: US 6,473,572 B1
(45) Date of Patent: Oct. 29, 2002

(54) IMAGE FORMING APPARATUS HAVING FUNCTION FOR JUDGING LIFE OF UNIT DETACHABLY MOUNTABLE THERETO, AND UNIT DETACHABLY MOUNTABLE TO IMAGE FORMING APPARATUS

(75) Inventors: Akihiko Uchiyama, Numazu; Akihiko Takeuchi, Susono, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/711,509

(22) Filed: Nov. 14, 2000

(30) Foreign Application Priority Data

Nov. 19, 1999 (JP) ..... 11-330605

(51) Int. Cl.[7] ..... G03G 15/00
(52) U.S. Cl. ..... 399/24; 399/43; 399/55
(58) Field of Search ..... 399/24, 25, 27, 399/12, 42, 43, 29, 55

(56) References Cited

U.S. PATENT DOCUMENTS 5,235,384 A * 8/1993 Oka et al. ..... 399/27
5,412,455 A 5/1995 Ono et al. ..... 355/219
5,778,279 A * 7/1998 Kawai et al. ..... 399/42
5,835,817 A * 11/1998 Bullock et al. ..... 399/25
5,995,774 A * 11/1999 Applegate et al. ..... 399/27
6,173,128 B1 * 1/2001 Saber et al. ..... 399/24

FOREIGN PATENT DOCUMENTS

JP 58-132758 * 8/1983

* cited by examiner

*Primary Examiner*—Joan Pendegrass
(74) *Attorney, Agent, or Firm*—Fitzpatrick, Cella, Harper & Scinto

(57) ABSTRACT

An image forming apparatus including a unit detachably mountable on the image forming apparatus, the unit having a developing device for developing a latent image formed on an image bearing member, a developing bias setter for setting a developing bias so that an image developed by the developing device maintains a predetermined density, and a life determiner for determining a life of the unit in accordance with a developing bias set by the developing bias setter and a reference bias. The reference bias is set in accordance with data relating to a used amount of the unit.

21 Claims, 11 Drawing Sheets

IMAGE FORMING APPARATUS HAVING FUNCTION FOR JUDGING LIFE OF UNIT DETACHABLY MOUNTABLE THERETO, AND UNIT DETACHABLY MOUNTABLE TO IMAGE FORMING APPARATUS

BACKGROUND OF THE INVENTION

1. Field of the Invention

The present invention relates to an image forming apparatus such as a copying machine, a printer and the like, and a unit detachably mountable to such an image forming apparatus, and more particularly, it relates to an image forming apparatus having a function for judging a life (service life) of a unit detachably mountable to such an image forming apparatus, and such a unit detachably mountable to the image forming apparatus.

An electrophotographic image forming apparatus as an example of such an image forming apparatus may include, for example, an electrophotographic copying machine, an electrophotographic printer (for example, LED printer, laser beam printer or the like) and an electrophotographic facsimile.

Further, a cartridge detachably mountable to a main body of the electrophotographic image forming apparatus is referred to as a unit which includes at least one of an electrophotographic photosensitive member, charging means for charging the electrophotographic photosensitive member, developing means for supplying developer to the electrophotographic photosensitive member and cleaning means for cleaning the electrophotographic photosensitive member. Particularly, a process cartridge is referred to as a cartridge which integrally incorporates at least one of charging means, developing means and cleaning means, and an electrophotographic photosensitive member as a unit which can detachably mounted to a main body of the electrophotographic image forming apparatus or which integrally incorporates at least developing means and an electrophotographic photosensitive member as a unit which can detachably mounted to a main body of the electrophotographic image forming apparatus.

2. Related Background Art

In conventional image forming apparatuses of electrophotographic type such as electrophotographic copying machine and laser beam printers, after an electrophotographic photosensitive member as an image bearing member is uniformly charged, a latent image is formed by projecting a beam corresponding to image information on a surface of the photosensitive member, and the latent image is then visualized by developing means for supplying developer to the latent image, and the visualized image is then transferred from the electrophotographic photosensitive member to a recording medium, thereby forming an image on the recording medium.

As such an image forming apparatus of electrophotographic type, both a monochromatic image forming apparatus and a color image forming apparatus have been put to a practical use.

Further, in the past, while a color copying machine of the electrophotographic type has been manufactured actively, in recent years, compactness of the apparatus has been considered important so as to apply the laser beam system to a desk-top color printer. Due to an increase in memory capacity and CPU performance of a host computer and the popularization of digital cameras and scanners, even for personal use, image processing and color DTP have been affected. And, as the resolving power of image data to be processed is increased, high quality image output of the color printer has been requested.

In monochromatic printers, since a laser-beam system having high image quality, reliability and high speed operation has been normally used in business use, the application of such a system to color processing has highly been requested. However, since there arises a problem that the entire apparatus becomes bulky and complicated due to multi-colorization, in order to promote its popularization in the market, increased compactness, low cost, reliability similar to the monochromatic system, and easy maintenance must be realized.

In order to realize easy maintenance, there has been proposed a process cartridge system in which an electrophotographic photosensitive member, and charging means, developing means and cleaning means as process means acting on the electrophotographic photosensitive member, and a developer container and a waste developer container are integrally incorporated as a unit which can detachably be mounted to a main body of the image forming apparatus. According to such a process-cartridge system, since the maintenance of the apparatus can be performed by the user himself without any serviceman, operability can be improved considerably. Thus, the process cartridge system has widely been used with the electrophotographic image forming apparatus. By using the process-cartridge system, the user can easily replenish the developer and exchange the electrophotographic photosensitive member, which otherwise are troublesome.

Such a process cartridge system is also adopted to the color electrophotographic image forming apparatus. For example, there is a color printer to which a process cartridge integrally incorporating therein the electrophotographic photosensitive member, charging means, cleaning means and developing means can detachably be mounted.

Further, for example, when the consumption conditions of plural color developing devices each having developing means and a developer container are different or when the consumption conditions of the electrophotographic photosensitive member and the developing means are different, in order to cope with this, for example, a developing cartridge for each color including the developing means and the developer container or a photosensitive drum cartridge integrally including the cleaning means, the waste developer container and the electrophotographic photosensitive member, which cartridge is independently detachably mountable to the main body of the apparatus, has been proposed to permit independent exchange and maintenance of respective color developing means and the electrophotographic photosensitive member.

In order to further improve the easy maintenance of the image forming apparatus of the process-cartridge type, it is desirable to timely inform the user of the exchanging time of the cartridge. To this end, it is required that the life of the cartridge be detected correctly.

For example, in the process cartridge integrally including the electrophotographic photosensitive member and at least developing means, when the life of the cartridge is detected, since the life of the electrophotographic photosensitive member does not always coincide with the life of the developing device, in the past, the respective service lives have been detected and the shorter life has been regarded as the life of the process cartridge.

Normally, the detection of the life of the electrophotographic photosensitive member is effected by using, as consumed amount information of the electrophotographic photosensitive member, the image formed copy number or the number of revolutions of the cylindrical electrophotographic photosensitive member (photosensitive drum). On the other hand, the detection of the life of the developing device is effected by seeking a developer remaining amount as consumed amount information of the developing device by measuring the developer remaining amount by means of an optical system or a capacitance measuring system or by guessing a developer amount (developing amount) used in development on the basis of the number of pixels of the latent image formed on the electrophotographic photosensitive member, which is called as "pixel count".

However, in actuality, even if the image formed copy number or the developer remaining amount does not signify the end of the life of the cartridge, normal image formation may not be attained.

For example, if image formation with a low image ratio is effected frequently, the developer will deteriorate faster than the normal case. in this case, even if the image formed copy number or the developer remaining amount does not signify the end of the life of the cartridge, since the correct image formation becomes impossible, it must be regarded that the life of the cartridge is expired.

Accordingly, the life of the cartridge (unit) can be not always judged correctly only on the basis of usage amount information, such as the image formed copy number or the developer remaining amount, and, thus, it is requested to provide an apparatus whose life, which cannot be judged only on the basis of the usage amount information, can also be judged.

SUMMARY OF THE INVENTION

The present invention aims to eliminate the above-mentioned conventional drawbacks, and an object of the present invention is to provide an image forming apparatus which can correctly judge the life of a unit which can detachably mounted to a main body of the apparatus, and a unit detachably mountable to such an apparatus.

Another object of the present invention is to provide an image forming apparatus comprising a unit detachably mountable on the image forming apparatus, the unit having developing means for developing a latent image formed on an image bearing member, and life judging means for judging the life of the unit on the basis of the developing bias applied to the developing means.

A further object of the present invention is to provide a unit detachably mountable on an image forming apparatus, comprising developing means for developing a latent image formed on an image bearing member, and a memory, wherein the memory stores a value of developing bias applied to the developing means.

A still further object of the present invention is to provide an image forming apparatus comprising a unit detachably mountable on the image forming apparatus, the unit having developing means for developing a latent image formed on an image bearing member, and life judging means for judging a life of the unit on the basis of the image density of a test pattern formed by the developing means.

A further object of the present invention is to provide a unit detachably mountable on an image forming apparatus, comprising developing means for developing a latent image formed on an image bearing member, and a memory, wherein the memory stores image density data when gradation control is effected.

The other objects and features of the present invention will be apparent from the following detailed explanation of the invention referring to the accompanying drawings.

DETAILED DESCRIPTION OF THE PREFERRED EMBODIMENTS

An image forming apparatus according to the present invention, and a cartridge (unit) detachably mountable on such an image forming apparatus will now be fully explained with reference to the accompanying drawings.

First Embodiment

Figure 1:
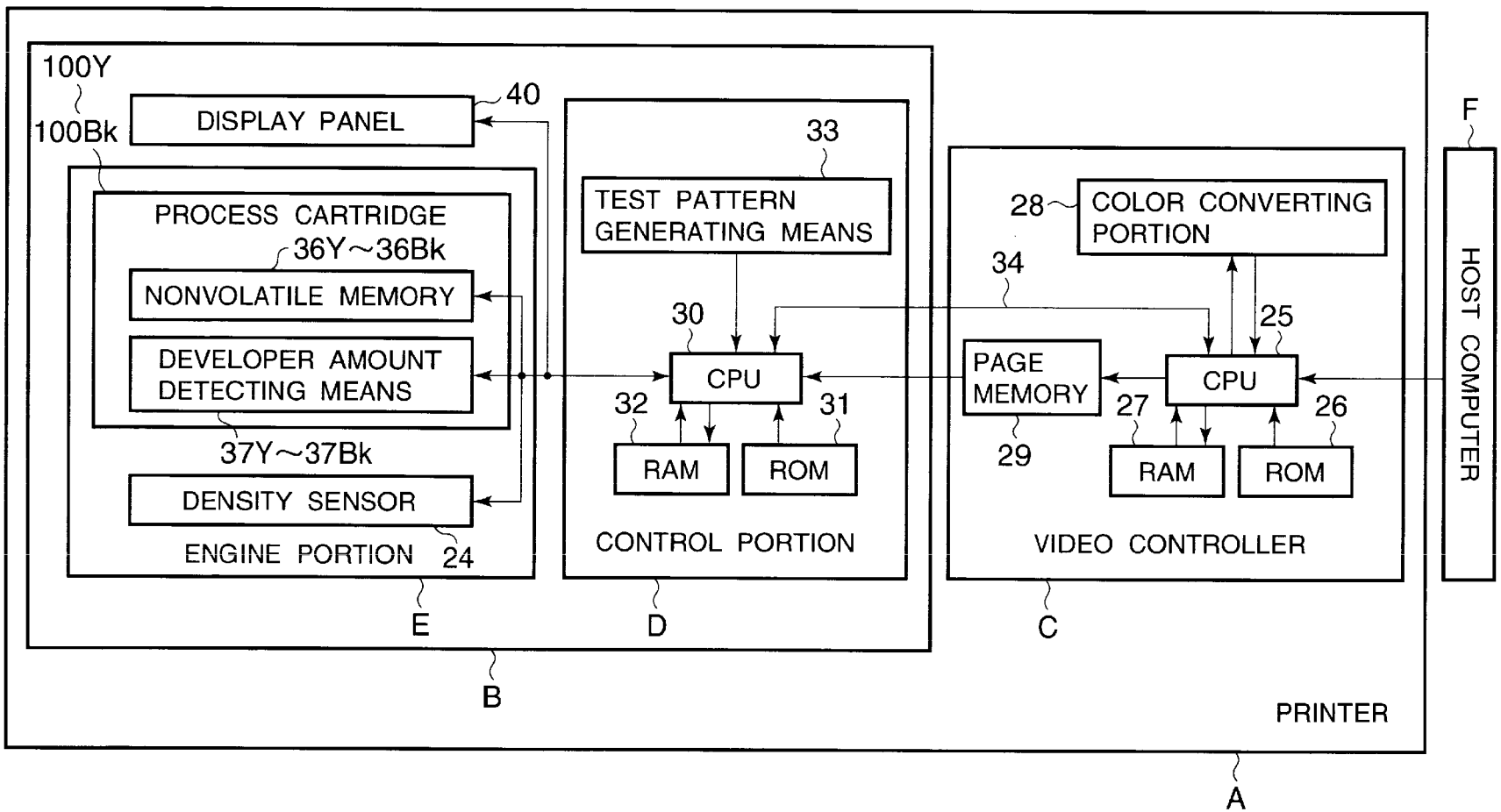
FIG. 1 is a schematic constructural view of an image forming apparatus according to an embodiment of the present invention on which a cartridge can detachably mountable.
Figure 2:
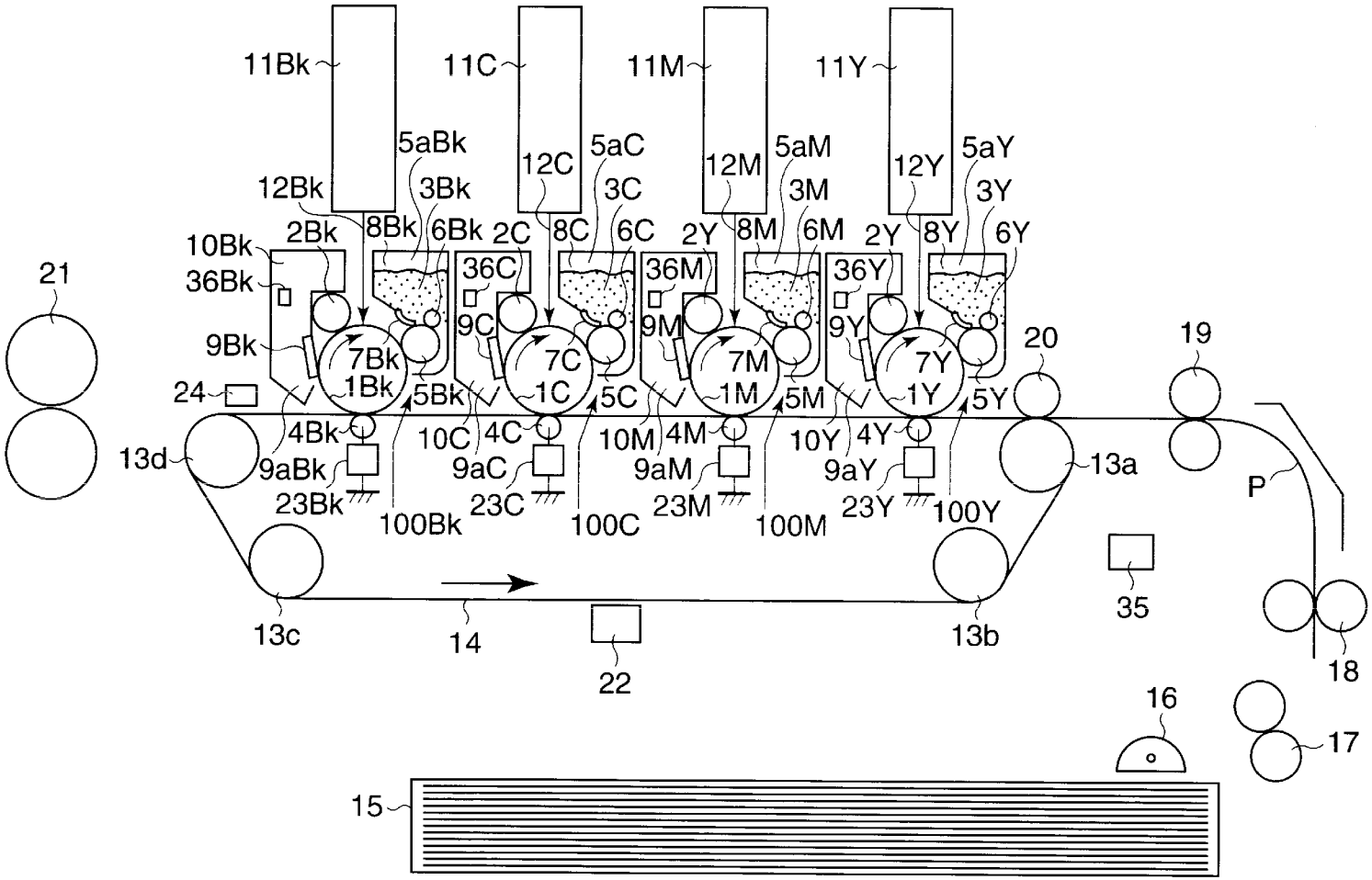
FIG. 2 is a schematic constructural view showing an embodiment of an engine portion of the image forming apparatus constructed in accordance with the present invention.

First of all, an embodiment of an electrophotographic image forming apparatus on which a cartridge can detachably mounted will be described with reference to FIGS. 1 and 2. FIG. 1 shows a schematic construction of an image forming apparatus to which the present invention is applied. FIG. 2 shows a schematic construction of an engine portion of the image forming apparatus according to this embodiment. In this embodiment, the image forming apparatus is a so-called four-drum type full-color printer (referred to merely as "printer" hereinafter).

As shown in FIG. 1, the printer A according to the illustrated embodiment includes a printer engine B and a video controller C. Further, a host computer F is connected to the printer A so that image information formed by the host computer F using application software can be sent to the printer A as code data expressed by printer language or image data.

The image information sent to the printer A is firstly processed by the video controller C. The video controller C includes a CPU 25 for controlling the video controller C, a ROM 26 for storing program executed by the CPU 25 and various data such as font data, and a RAM 27 used as a working memory. Further, the video controller C further includes a color converting portion 28 for converting red (R), green (G) and blue (B) image data (RGB data) into yellow (Y), magenta (M), cyan (C) and black (Bk) image data (YMCBk data). The color conversion is generally called a color masking process and is effected by using a determinant calculation or a look-up table. The image information inputted to the video controller C is interpreted by the CPU 25 and is stored in a page memory 29 in a form suitable for the printer engine B. In this case, in a case where the image information is the RGB data, the color masking process is effected by the color converting portion 28 to convert the data into the YMCBk data. On the other hand, in case of monochromatic data or YMCBk data, processing such as density adjustment is effected, if necessary. The image data stored in the image memory 29 is sent to the printer engine B at a predetermined timing.

The printer engine B includes a control portion D and an engine portion E. The control portion D includes a CPU 30 for controlling the engine portion E, a ROM 31 for storing program executed by the CPU 30 and various data, and a RAM 32 used as a working memory. Further, the CPU 30 of the control portion D can effect inter-communication with the CPU 25 of the video controller C by using a signal line 34. Further, in the illustrated embodiment, the control portion D is provided with test pattern generating means 33. The test pattern generating means 33 may be provided in the video controller C in place of the control portion D.

FIG. 2 is a side sectional view of the engine portion E. The engine portion E is provided with a transfer belt 14 which is mounted around rollers 13*a*, 13*b*, 13*c*, 13*d* under tension to be rotated in a direction shown by the arrow in FIG. 2 for conveying a recording medium P.

The engine portion E includes yellow (Y), magenta (M), cyan (C) and black (Bk) color image forming portions. For example, explaining the yellow image forming portion, the yellow image forming portion includes a drum unit 10Y having an yellow image forming OPC photosensitive drum 1Y which is a cylindrical electrophotographic photosensitive member as an image bearing member, cleaning means 9Y and a charging roller 2Y as charging means. Further, it also includes a developing unit (developing device) 8Y having a developing sleeve 5Y as a developer carrying member, a developer container 5*a*Y containing non-magnetic one-component developer 3Y as developer, a developer coating roller 6Y as developer coating means on the developing sleeve 5Y, and developer coating blade 7Y as developer layer thickness regulating means.

Figure 3:
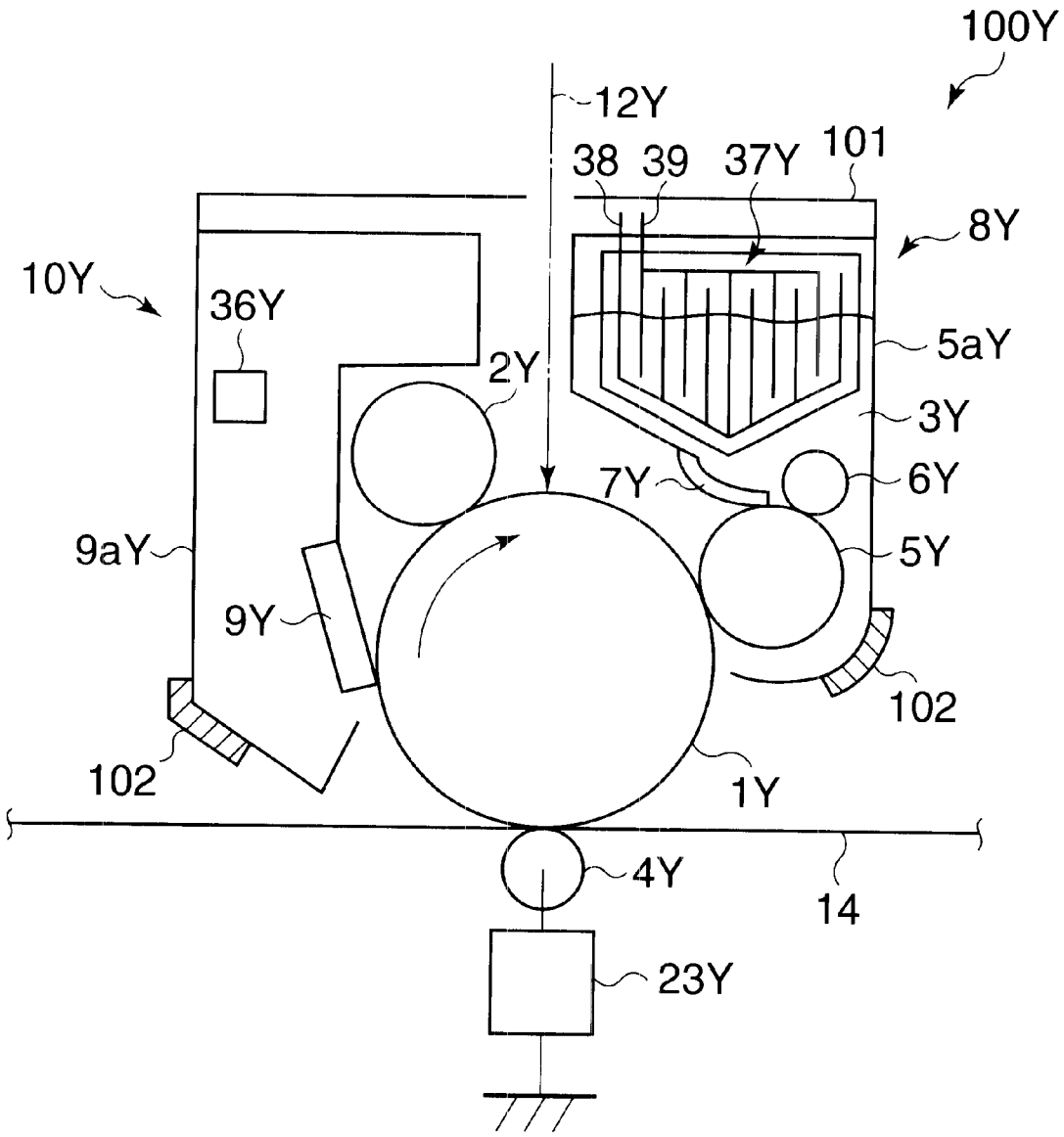
FIG. 3 is a schematic constructural view showing an embodiment of a process cartridge according to the present invention.

As can be understood also by referring to FIG. 3, in the illustrated embodiment, the drum unit 10Y and the developing unit 8Y are integrally combined by a frame 101 to form a process cartridge 100Y which can detachably be mounted to a main body of the apparatus. The process cartridge 100Y is detachably mountable to the main body of the image forming apparatus in a predetermined manner via mounting means 102 provided in the main body of the image forming apparatus.

Further, the yellow image forming portion is provided with an exposing apparatus 11Y. An LED array or a scanner unit for causing a laser beam to scan through a polygon mirror can be used as the exposing apparatus 11Y. In the illustrated embodiment, a laser scanner unit is used as the exposing apparatus 11Y. The exposing apparatus 11Y serves to illuminate a scanning beam 12Y modulated on the basis of an image signal onto the photosensitive drum 1Y.

Further, the yellow image forming portion is provided with a transfer roller 4Y as transfer means. The transfer roller 4Y is connected to a transfer bias power supply 23Y. At a transfer nip defined between the photosensitive drum 1Y and the transfer roller 4Y, a toner image formed on the photosensitive drum 1Y is transferred onto the recording medium P conveyed by the transfer belt 14.

Since constructions of the other color image forming portions are the same as the above-mentioned construction of the yellow image forming portion, explanation thereof will be omitted. Similar to the yellow image forming portion, to the magenta, cyan and black image forming portions, the respective color process cartridges 100M, 100C, 100Bk which are detachably mountable on the main body of the image forming apparatus are mounted. Incidentally, in FIG. 2, members having the same function and construction as those of the yellow image forming portion are designated by the same reference numerals with letters Y, M, C, Bk added.

In the above-mentioned construction, the CPU 30 of the control portion D rotates the photosensitive drums 1Y, 1M, 1C, 1Bk and the transfer belt 14 at a predetermined process speed in directions shown by the arrows in FIG. 2 in synchronism with an image-formation start signal from the video controller C. The photosensitive drum 1Y is uniformly charged by the charging roller 2Y, and then, an electrostatic latent image corresponding to the image information sent from the video controller C is formed by the scanning beam 12Y from the exposing apparatus 11Y. When the photosensitive drum 1Y is further rotated, the electrostatic latent image is visualized by the developing unit 8Y, thereby forming an yellow toner image on the photosensitive drum 1Y. That is to say, the developer contained in the developer container 5*a*Y of the yellow developing unit 8Y is tribo-charged by the developer coating roller 6Y and is supplied to the developer sleeve 5Y. The developer supplied to the developing sleeve 5Y is then passed through a contact area between the developer coating blade 7Y and the developing sleeve; meanwhile, a thickness of a developer layer is regulated and tribo-electricity is given to the developer layer, thereby forming the developer layer having the predetermined thickness on the developing sleeve 5Y. Then, the developer layer is sent to an area where the developing sleeve is opposed to the photosensitive drum 1Y. Development is effected by transferring the developer onto an image portion of the electrostatic latent image, thereby forming the toner image on the photosensitive drum 1Y. During the development, normally, a developing bias obtained by superposing DC voltage on AC voltage is applied to the developing sleeve 5Y.

On the other hand, the recording media P contained in a recording medium cassette 15 are picked up by a semicircular sheet feeding roller 16 and are separated one by one by means of a recording material separating roller 17. The separated recording medium is conveyed to a pair of registration rollers 19 by a convey roller 18. In synchronism with the toner image on the photosensitive drum 1Y, the recording medium P is fed out by the pair of registration rollers 19.

The recording medium P is electrostatically absorbed on the transfer belt 14 by voltage applied between an absorbing roller 20 and the roller 13*a*, and then, the toner image on the photosensitive drum 1Y is transferred onto the recording medium P by the transfer roller 4Y. In synchronism with conveyance of the recording medium P effected by the transfer roller 14, the formation of toner images in the M, C, Bk image forming portions and transferring of the toner images onto the recording medium P is successively repeated. Then, the recording medium P to which Y, M, C, Bk toner images were transferred is separated from the transfer belt 14 and then is sent to a fixing apparatus 21, where the toner images are fused and fixed to the recording medium P, thereby forming a color image.

After the transferring operation, the developers remaining on the photosensitive drums 1Y, 1M, 1C, 1Bk are cleaned by cleaning means 9Y, 9M, 9C, 9Bk comprising a fur brush or a blade, and the developers removed from the photosensitive drums 1Y, 1M, 1C, 1Bk are collected into waste developer containers 9*a*Y, 9*a*M, 9*a*C, 9*a*Bk. Further, the developer adhered to the transfer belt 14 is cleaned by transfer belt cleaning means 22 comprising a blade, a fur brush or a web.

Figure 4:
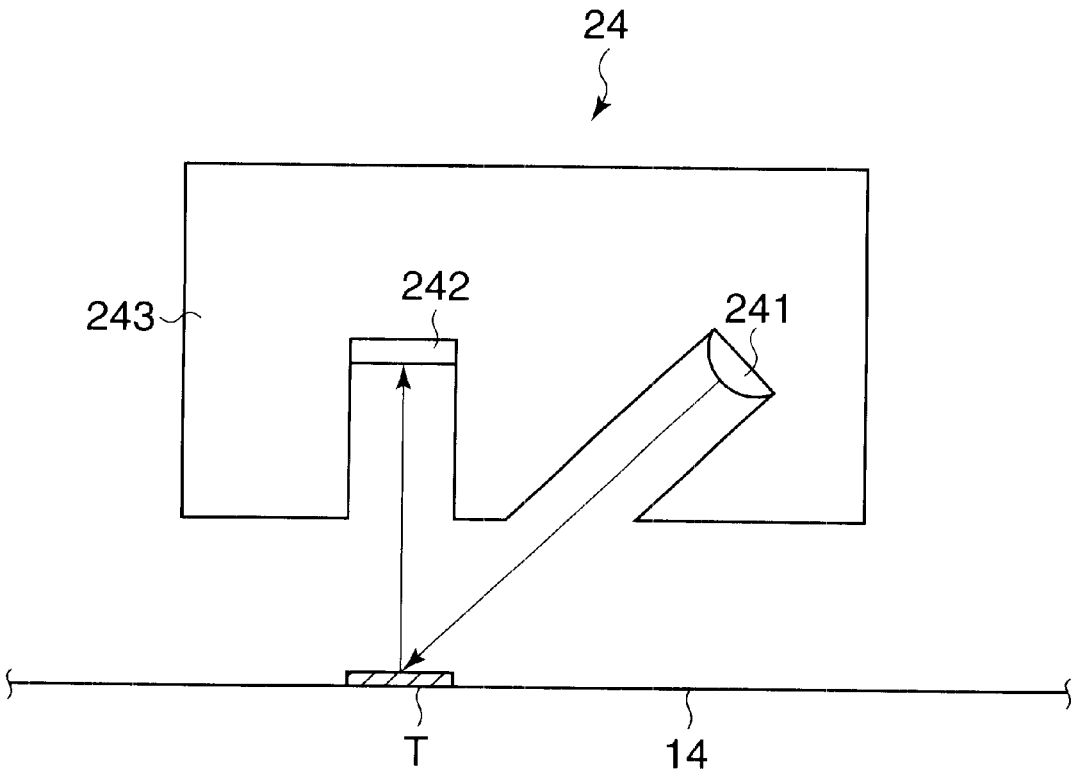
FIG. 4 is a schematic constructural view showing an embodiment of an image density sensor provided in the image forming apparatus.

According to the illustrated embodiment, the engine portion E is provided with a density sensor 24 as image density detecting means. As shown in FIG. 4, the density sensor 24 can be constituted by a light emitting element 241 such as an LED, a light receiving element 242 such as a CdS, an a holder 243 and serves to measure the image-density controlling toner image (patch) T by illuminating, with light from the light emitting element 241, the patch T formed on the transfer belt 14 and by receiving light reflected from the belt by the light receiving element 242.

Further, in the illustrated embodiment, the engine portion E is provided with a temperature/humidity sensor 35 for measuring an environment within which the main body of the apparats is installed. The density sensor 24 and the temperature/humidity sensor 35 are connected to the control portion D through connecting means (not shown) so that respective measurement data is sent to the CPU 30 of the control portion D.

The measurement data from the temperature/humidity sensor 35 is, for example, a moisture amount x in air (moisture amount g per 1 kg air (g/kg)) sought from a temperature t (° C.) and relative humidity $\phi$(% RH), and such data can be used as environment data. Incidentally, the value x is 21.5 grams at 30° C. and 80% RH, 1.1 grams at 15° C. and 10% RH and 11.8 grams at 25° C. and 60% RH under the atmospheric pressure of 760 mmHg (101325 Pa).

Further, the respective process cartridges 100Y to 100Bk are provided with non-volatile memories 36Y, 36M, 36C, 36Bk as memory means which will be fully described later, which memories are connected to the control portion D for communication with each other, via connecting means or non-contact type communication means (not shown).

In the electrophotographic color image forming apparatus, if the image density is changed by a change in environment in which the apparatus is used or various conditions such as the number of image formation operations, the truly correct color cannot be obtained. To avoid this, in the illustrated embodiment, by effecting image density control, a stable color image can always be obtained.

The image density control in the illustrated embodiment comprises maximum density control (Dmax control) for matching the maximum density of the image with a predetermined density, and gradation control for matching a gradation property of the image with a predetermined property. Among them, concretely, the Dmax control is effected as follows.

First of all, when an elapsed time after turning ON of the power supply of the body of the printer A, the number of image formation operations, and a proper timing, such as an instruction from the host computer or the user, are detected by the CPU 30 of the control portion D, the CPU 30 starts the Dmax control.

Then, the CPU 30 reads out respective color developing biases for the Dmax control and control target density for the Dmax control, from the ROM 31 of the control portion D. Thereafter, the CPU 30 starts an initial operation of the main body of the image forming apparatus and charges the photosensitive drums 1Y, 1M, 1C, 1Bk with predetermined charging biases.

Then, the CPU 30 of the control portion D sends the image data of the patch generated from the test pattern generating means 33 to the exposing apparatus 11Y, thereby forming a latent image for five patches TY1 to TY5 on the photosensitive drum 1Y along a rotational direction thereof by using the same image data. These latent images are developed by the developing unit 8Y. In this case, the patch TY1 is developed by developing bias VY1, patch TY2 is developed by developing bias VY2, patch TY3 is developed by developing bias VY3, patch TY4 is developed by developing bias VY4, and patch TYS is developed by developing bias VY5 (VY1<VY2<VY3<VY4<VY5).

Figure 5:
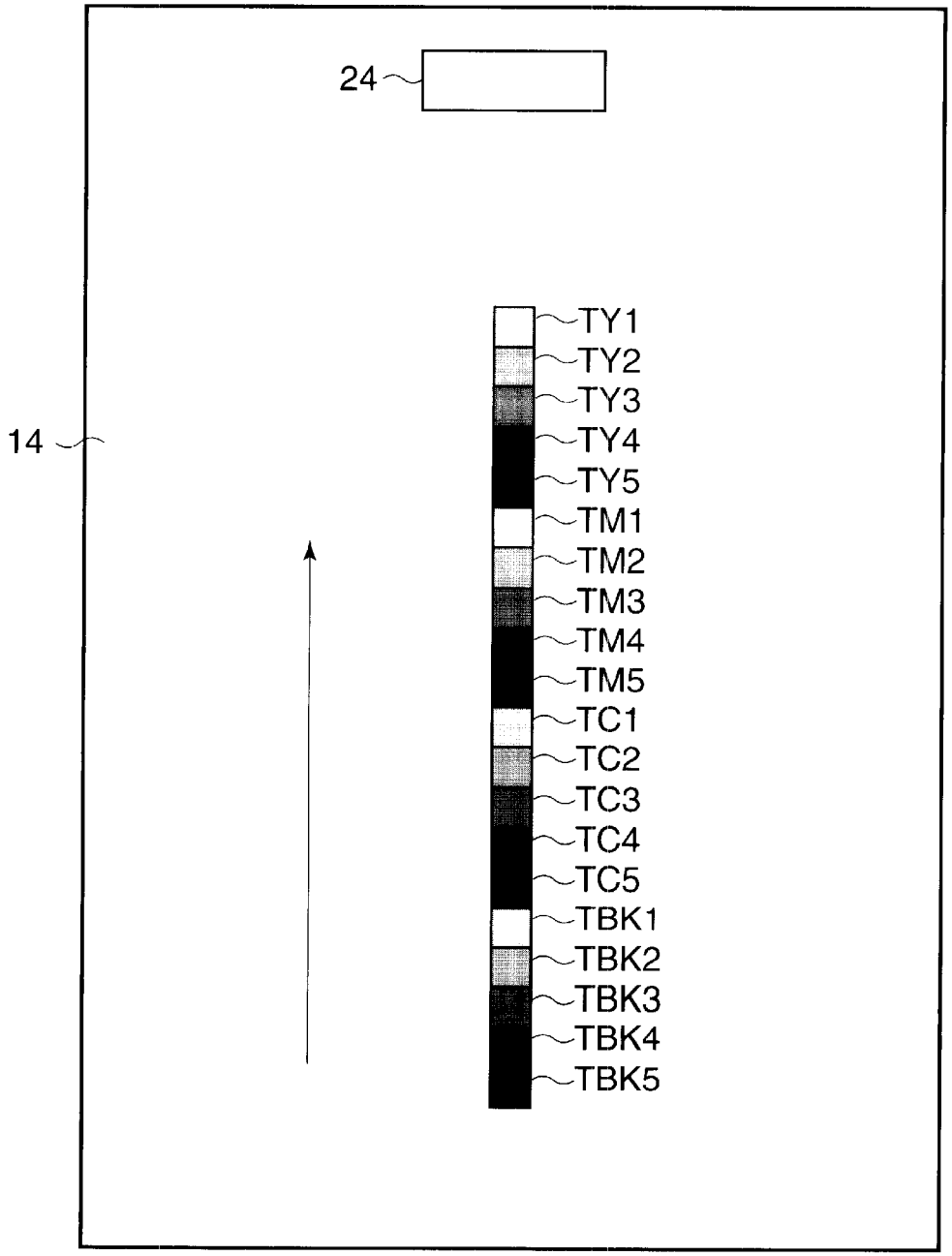
FIG. 5 is a view for explaining a patch image formed on a transfer belt.

The toner images as the patches TY1 to TY5 formed on the photosensitive drum 1Y are transferred onto the transfer belt 14 by voltage applied between the photosensitive drum 1Y and the transfer roller 4Y. And, the yellow (Y), magenta (M), cyan (C) and black (Bk) patches are similarly formed, with the result that the patches are formed on the transfer belt 14 as shown in FIG. 5.

Densities of these patches TY1 to TY5, TM1 to TM5, TC1 to TC5 and TBk1 to TBk5 are measured by the density sensor 24, and density measurement values DY1 to DY5, DM1 to DM5, DC1 to DC5 and DBk1 to DBk5 are written in the RAM 32 of the control portion D.

On the other hand, the patches formed on the transfer belt 14 are cleaned by the transfer belt cleaning means 22.

Figure 6:
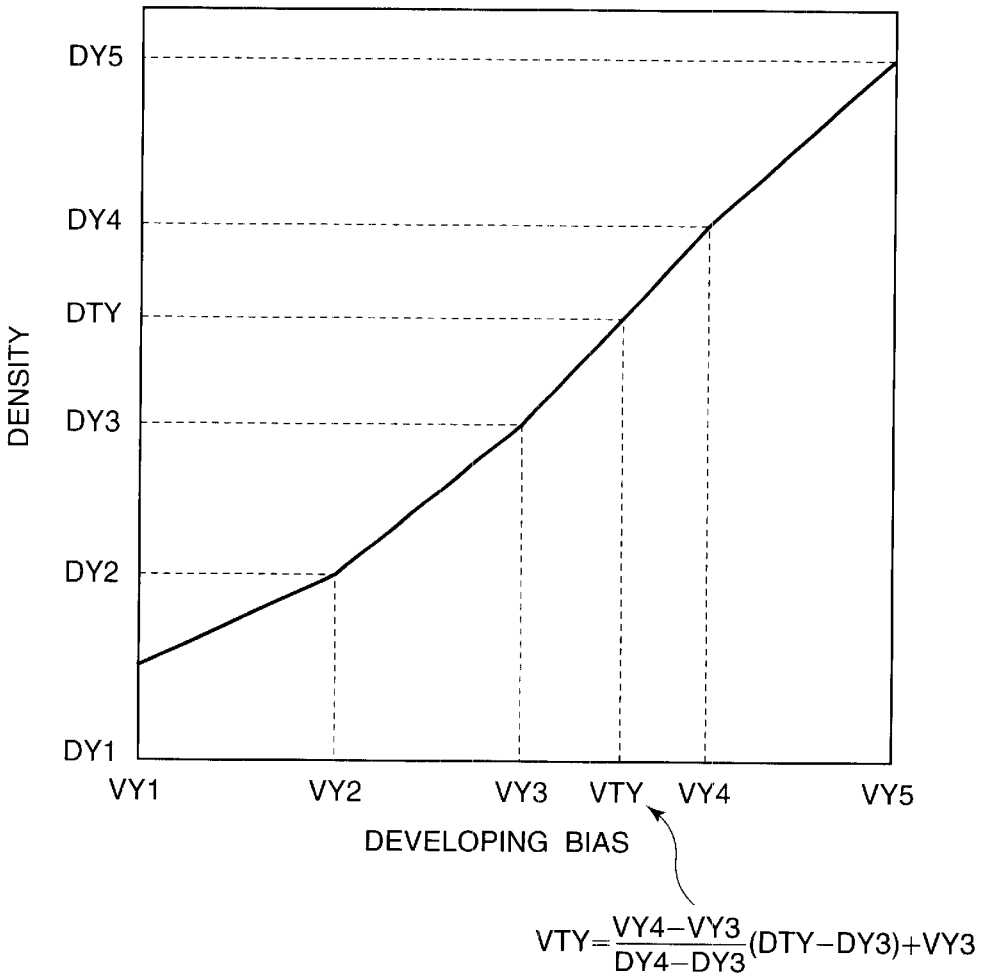
FIG. 6 is a graph showing the relationship between developing bias and image density, for explaining a conception for calculating the developing bias under maximum density control (Dmax control)

After the measurement of the patches is finished, the CPU 30 effects calculation of the developing bias as a developing condition required for obtaining the predetermined Dmax on the basis of the densities of the patches stored in the RAM 32. For example, when the latent images for the yellow (Y) density detecting patches TY1 to TY5 are developed with different developing biases VY1 to VY5, densities DY1 To DY5 measured by the density sensor 24 become as shown in FIG. 6. As shown in FIG. 6, the developing biases VY1 to VY5 are previously set on the basis of the environment data calculated from the measurement data of the temperature/humidity sensor 35 so that the control target density DTY is always included within a section between DY1 and DY5. The developing bias VTY required for obtaining the control target density DTY can be sought from the following linear interpolation by using the developing biases (in this case, VY3 and VY4) and patch densities (in this case, DY3 and DY4) on both sides of the control target density DTY:

$$VTY=\{(VY4-VY3)/(DY4-DY3)\}(DTY-DY3)+VY3$$

Similarly, the CPU 30 seeks the other color developing biases VTM, VTC, VTBk, and these values are written in the RAM 32 of the control portion D and in memories 36Y to 36Bk of the cartridge. In the succeeding image formation operation until the initiation of the next density control, these biases are used. The developing biases VTY, VTM, VTC, VTBk are renewed whenever the density control is effected.

When the developing biases are set by the above-mentioned Dmax control, then, the gradation control is performed as follows.

First of all, the CPU 30 of the control portion D starts the initial operation of the main body of the image forming apparatus and charges the photosensitive drums 1Y to 1Bk with predetermined charging biases. Then, the CPU 30 sends image data SY1 to SY7 for gradation controlling patches generated from the test pattern generating means 33 to the exposing apparatus 111Y, thereby forming latent images for seven patches T'Y1 to T'Y7 on the photosensitive drum 1Y along the rotational direction thereof.

Here, the image data SY1 to SY7 are previously set on the basis of the environment data calculated from the measurement data of the temperature/humidity sensor 35 so that the densities of the patches T'Y1 to T'Y7 are changed with a constant interval. These latent images are developed by the developing unit 8Y with the developing bias VTY set by the Dmax control. The toner images as the patches T'Y1 to T'Y7 formed on the photosensitive drum 1Y are transferred onto the transfer belt 14 by voltage applied between the photosensitive drum 1Y and the transfer roller 4Y. And, the yellow (Y), magenta (M), cyan (C) and black (Bk) patches are similarly formed, with the result that the patches are formed on the transfer belt 14. The densities of these patches T'Y1 to T'Y7, T'M1 to T'M7, T'C1 to T'C7 and T'Bk1 to T'Bk7 are measured by the density sensor 24, and density measurement values D'Y1 to D'Y7, D'M1 to D'M7, D'C1 to D'C7 and D'Bk1 to D'Bk7 are written in the RAM 32 of the control portion D.

On the other hand, the patches formed on the transfer belt 14 are cleaned by the transfer belt cleaning means 22.

Figure 7:
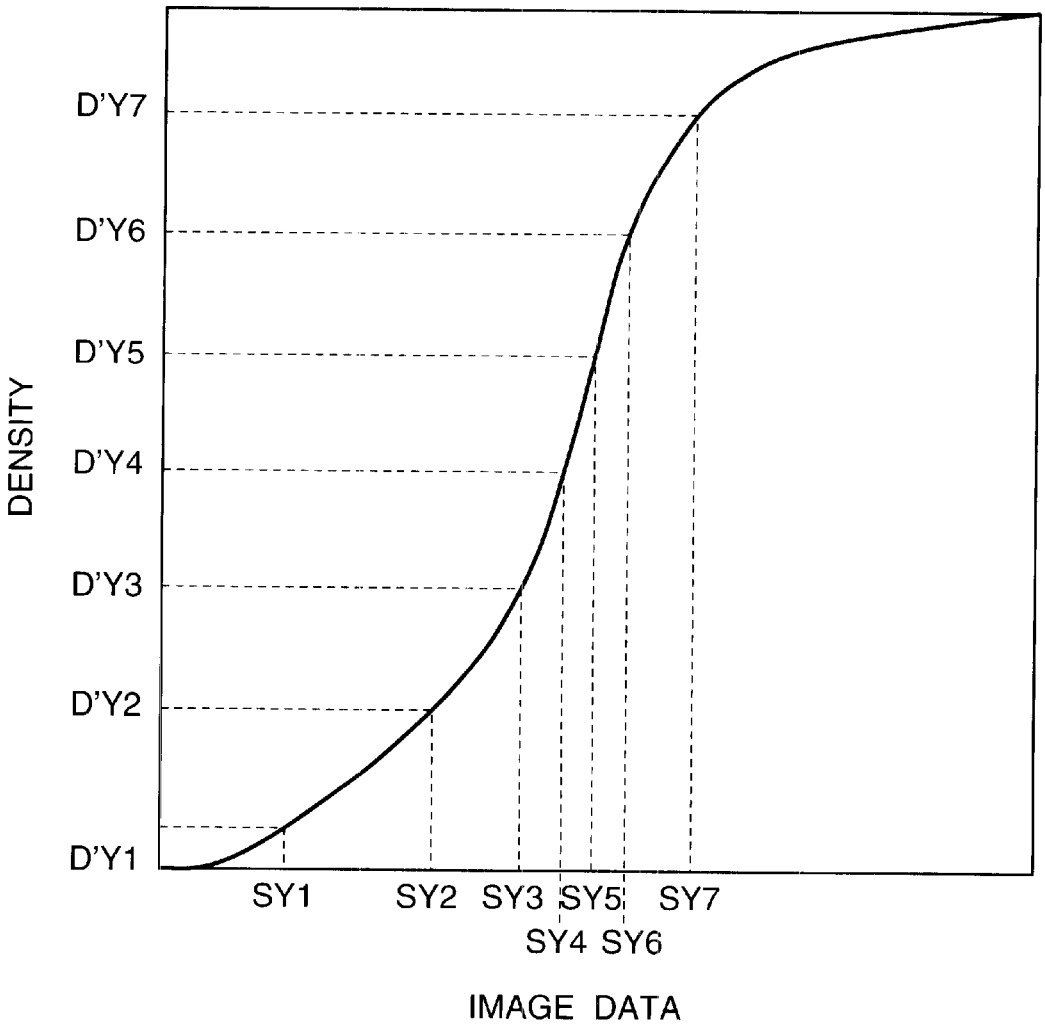
FIG. 7 is a graph showing the relationship between image data and image density, for explaining a gradation property of an image in an electrophotographic image forming apparatus.

After the measurement of the patches is finished, the CPU 30 seeks the gradation property of pixels of the printer A by effecting interpolation between the patch densities stored in the RAM 32 and the image data by using a polynomial expression. Normally, the gradation property of pixels of the electrophotographic image forming apparatus becomes as shown in FIG. 7. Accordingly, there is provided a look-up table as a gradation correcting property for adjusting the relationship between the image data to be inputted to the printer engine B and the data to be sent to the exposing apparatus so that the gradation property becomes linear or a predetermined form based on the gradation property, and such a look-up table is stored in the RAM 32. In the succeeding image formation operation, gradation correction is effected by using this look-up table.

By the developing biases and the look-up table sought in this way, a stable color image can be obtained.

Incidentally, here, while an example that the Dmax control and the gradation control are effected continuously was explained, such controls may be effected at different timings.

Next, the detection of a end of the life of the cartridge in accordance with the present invention will be explained.

Figure 8:
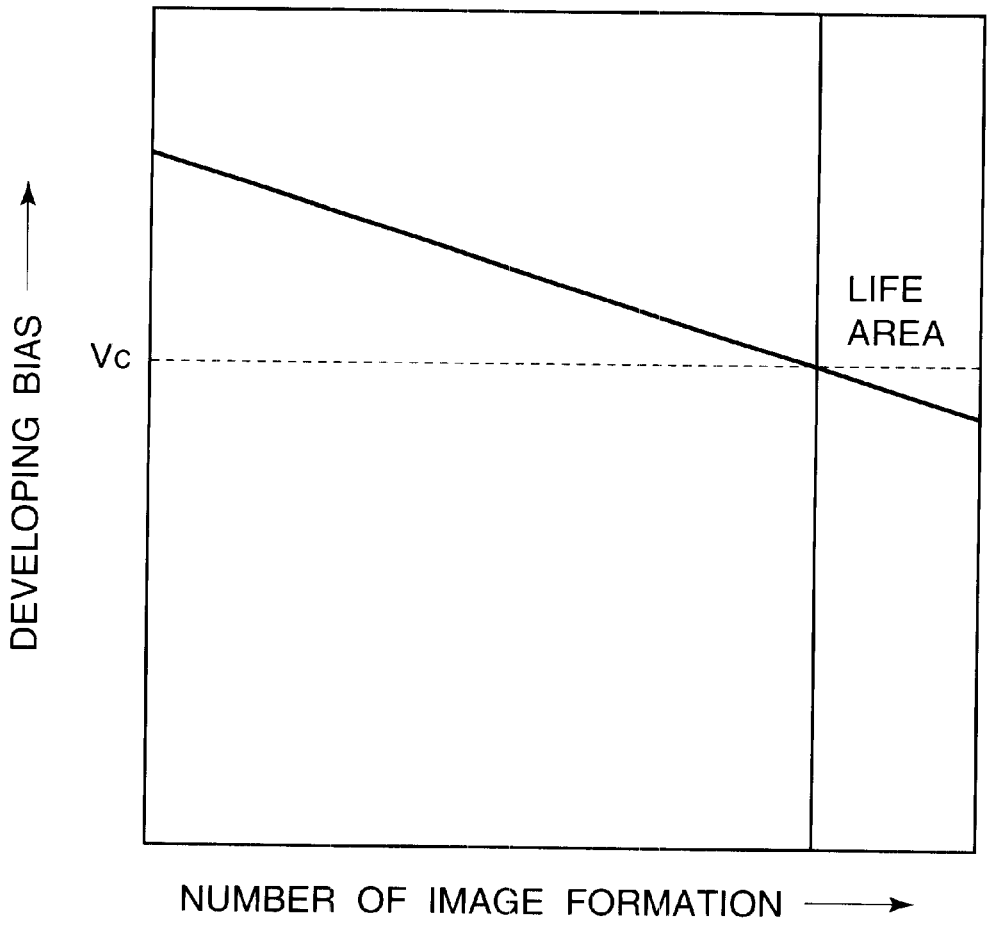
FIG. 8 is a graph showing the relationship between the number of image formations and the developing bias obtained by the Dmax control.

In the electrophotographic color image forming apparatus, when the number of image formation operations is increased, even if the charging device and the developing device are controlled by using constant parameters, since there is a tendency that the density of the image is increased, under a certain environment, the developing biases VTY to VTBk are changed to decrease the density as the number of image formation operations of the process cartridge 100Y to 100Bk is increased, as shown in FIG. 8.

If the developing biases are decreased below Vc, correct development becomes impossible, and, thus, a high quality image cannot be obtained. That is to say, when the developing biases are decreased below Vc, even if the photosensitive drums 1Y to 1Bk and/or the developer remaining amount do not reach their service lives, it is regarded that the service lives of the process cartridges 100Y to 100Bk, which are expected to achieve high quality image formation, are expired. Further, it was found that the change in developing bias depending upon the number of image formation operations as shown in FIG. 8 causes a similar change under different environments (while the value Vc is different). Namely, regardless of the number of prints, although the life of the cartridge can be judged correctly only by measuring the number of prints and the developer remaining amount, so long as the charge and feature of the developer are not changed, in actuality, since the charge and feature of the developer are changed in accordance with the number of prints, it was found that it is insufficient that the life of the cartridge is judged only on the basis of the number of prints and the developer remaining amount.

In consideration of the above, in the illustrated embodiment, in addition to the number of image formation operations and the developer remaining amount which were conventionally used to indicate the consumed amount of the cartridge, by considering the developing biases VTY to VTBk sought by the Dmax control, the life of the cartridge is detected more correctly.

According to the illustrated embodiment, the number of image formation operations PY to PBk and the developer remaining amount as the cartridge consumed amount information and the developing biases VTY to VTBk sought by the Dmax control as image-density-control information are written in the memory means 36Y, 36M, 36C, 36Bk (FIGS. 2 and 3) provided in the process cartridges 100Y to 100Bk, respectively. In the illustrated embodiment, further, environment data Env obtained by effecting the Dmax control is written in the memory means 36Y to 36B*k*.

By storing this information in the memory means 36Y to 36Bk of the cartridges, the lives of the process cartridges 100Y to 100Bk can always be detected correctly, and, by holding this information in the cartridges themselves, even if the cartridge is dismounted from the image forming apparatus, when the dismounted cartridge is again mounted to the image forming apparatus later, the correct life detection of the cartridge can be performed promptly.

As the memory means 36Y, 36M, 36C, 36Bk provided in the process cartridges 100Y to 100Bk, a read/write electronic memory using a normal semiconductor such as a non-volatile memory, a combination of a volatile memory and a back-up can be used without a special limitation. In the illustrated embodiment, as each of the memory means 36Y to 36Bk, the read/write non-volatile memory (referred to merely as "memory" hereinafter) is used. Alternatively, memories of the non-contact type capable of performing data communication between the memory means 36Y to 36Bk and the read/write IC by using an electromagnetic wave may be used. In this case, since the memories are not contacted with the main body, poor contact depending upon the mounting condition of the cartridge can be avoided.

In the illustrated embodiment, the number of image formation operations as the cartridge-consumed-amount information is counted by a conventional counter as cartridge-consumed-amount detecting means.

Further, in the illustrated embodiment, the developer remaining amount as the cartridge-consumed-amount information is successively detected by developer amount detecting means 37Y to 37Bk of the capacitance measuring type as cartridge-consumed-amount detecting means. That is to say, explaining the yellow image forming portion as an example, as shown in FIG. 3, each of the developer amount detecting means 37Y to 37Bk is constituted by an electrode member comprised of input and output side electrodes 38, 39 having at least one pair of portions disposed with a predetermined distance in parallel on a substrate, such as a flexible substrate. Under a condition that the process cartridge 100Y is mounted on the main body of the image forming apparatus, for example, when voltage is applied between the input and output side electrodes 38 and 39 through an input side electrode 38 of an electrode member 37Y provided on an inner side surface of the developer container 5*a*Y, the capacitance generated between the input and output side electrodes 38 and 39 is measured through the output side electrode 39. By successively detecting the capacitance varying with the contact area between the electrode member 37Y and the developer in this way, the developer amount can be detected successively.

However, in the present invention, the developer amount detecting means as the cartridge-consumed amount detecting means is not limited to the above-mentioned electrode member for the capacitance measuring type. For example, as the electrode member, there may be provided a metal plate opposed to the developing sleeve 5Y so that the capacitance generated between the developing sleeve 5Y and the metal plate when a developing bias is applied to the developing sleeve 5Y can be measured or there may be a plurality of metal plates within the developer container 5*a*Y so that the capacitance generated between the metal plates when voltage is applied between the metal plates can be measured. Further, as the developer amount detecting means, they are not limited to the capacitance measuring type, but, for example, so long as the developer amount can be detected successively, any means such as optical developer detecting means can be used regardless of type. Further, as the developer amount, a remaining amount of the developer to be used in development may be detected or the developer amount (development amount) used in development may be detected.

The above-mentioned the counter for counting the number of image formation operations or developer amount detecting means 37 as the cartridge consumed amount detecting means is electrically connected to the CPU 30 of the control portion D so that the CPU 30 can detect the cartridge-consumed-amount information successively.

Figure 9:
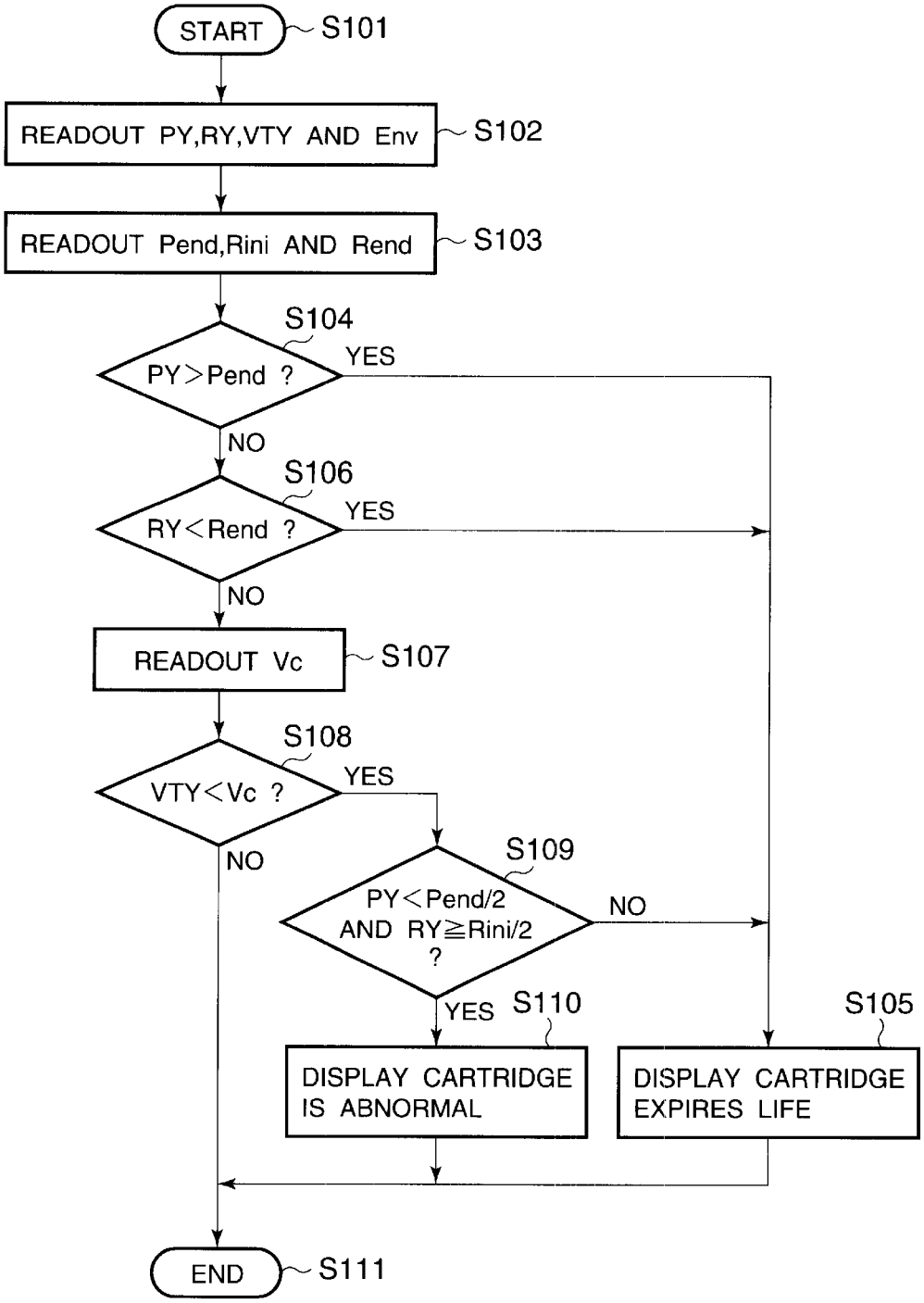
FIG. 9 is a flow chart for explaining an embodiment of the life detection of a cartridge in accordance with the present invention.

Next, an example of a cartridge life detecting operation according to the present invention, detection of a life of the process cartridge 100Y of the yellow (Y) image forming portion will be explained with reference to FIG. 9.

When the detection of the life of the process cartridge is started at a predetermined timing such as turn-ON of the power supply of the printer A or completion of the image formation (step S101), first of all, the CPU 30 of the control portion D reads out the number of image formation operations PY, the developer remaining amount RY, the developing bias VTY and the environment data Env under which the Dmax control was effected regarding the process cartridge 100Y from the memory 36Y of the process cartridge 100Y (step S102).

Then, the CPU 30 reads out a life value Pend of the number of image formation operations, the initial developer amount Rini and the life value Rend of the developer remaining amount previously stored in the ROM 31 of the control portion D (step S103).

Then, the CPU 30 judges whether the number of image formation operations PY exceeds the value Pend (step S104). If exceeded, the fact that the life of the cartridge is expired is displayed on a display panel 40 as displaying means provided on the main body of the image forming apparatus (step S105).

In the step S104, if it is judged that PY does not exceed Pend, then, the CPU 30 judges whether the developer remaining amount RY is decreased below the value Rend (step S106). If decreased below the value, the fact that the life of the cartridge is expired is displayed on the display panel 4 (step S105).

In the step S106, if it is judged that RY is not decreased below Rend, the CPU 30 reads out the life Vc of the developing bias estimated from the environment data Env under which the Dmax control was effected and the number of image formation operations PY from the ROM 31 of the control portion D (step S107) and judges whether the developing bias VTY is decreased below the value Vc (step S108). If it is judged that VTY is not decreased below Vc, since the life of the cartridge is not expired, the detection of the cartridge life is ended (step S111).

On the other hand, in the step S 108, if it is judged that the developing bias VTY is decreased below Vc, it means that the life of the cartridge is expired. However, in this case, if the number of image formation operations PY does not reach half of the life value Pend and the developer remaining amount RY is greater than half of the initial developer amount Rini, since the deterioration of the cartridge is abnormally fast, thus, it is guessed that there is a problem regarding usage or storage of the cartridge itself or any trouble. Thus, in the step S108, if VTY is decreased below Vc, it is judged whether PY does not reach Pend/2 or whether RY is not less than Rini/2 (step S109). If PY does not reach Pend/2 and RY is not less than Rini/2, the fact that the cartridge may be abnormal is displayed on the display panel 40 (step S110). If otherwise, the fact that the life of the cartridge is expired is displayed on the display panel (step S105). In this way, the detection of the life of the cartridge is ended (step S111).

Incidentally, threshold values of the number of image formation operations and the developer remaining amount by which the abnormality is judged in the step S109 may be set appropriately in accordance with the property of the cartridge.

While the cartridge-life detection regarding the process cartridge 100Y in the yellow image forming portion was explained, similarly, cartridge life detection of other color image forming portions can be effected successively or simultaneously.

Incidentally, in the forwarding of the process cartridges 100Y to 100Bk, in the memories 36Y to 36Bk thereof, normal temperature/humidity (25° C., 60 t) may be stored as the environment data, and values sufficiently greater than the values Vc derived from the environment data (25° C., 60 t) and the number of image formation operations 0 are subjected to default and are stored as the developing biases VTY to VTBk. Further, the timings for writing various data in the memories 36Y to 36Bk are not limited specially, but, it is preferable that the developing biases (VTY to VTBk) and the environment data (Env) be written immediately after the Dmax control and the numbers of image formation operations (PY to PBk) and the developer remaining amounts (RY to RBk) be written immediately after image formation.

As mentioned above, according to the present invention, the service lives of the process cartridges 100Y to 100Bk can always be detected correctly. Further, according to the present invention, by storing the cartridge consumed amount information and information (developing biases, in the illustrated embodiment) obtained from the image density control in the memory means 36Y to 36Bk provided in the process cartridges 100Y to 100Bk, even if the process cartridges 100Y to 100Bk are dismounted from the main body of the image forming apparatus before their lives are expired, when they are again mounted to the image forming apparatus later, the cartridge life detection suitable to the respective cartridge can be effected promptly.

Second Embodiment

Next, a second embodiment of the present invention will be explained. Fundamentally, an image forming apparatus according to the second embodiment is similar to that of the first embodiment. Accordingly, members having the same function and construction are designated by the same reference numerals and a detailed explanation thereof will be omitted.

In the first embodiment, while an example that the lives of the cartridges are detected correctly in consideration of the developing biases VTY to VTBk sought by the maximum density control (Dmax control) as the information obtained from the image density control, as well as the cartridge-consumed-amount information was explained, in the second embodiment, by considering an image gradation property as the information obtained from the image density control, the lives of the cartridges are detected correctly.

Figure 10:
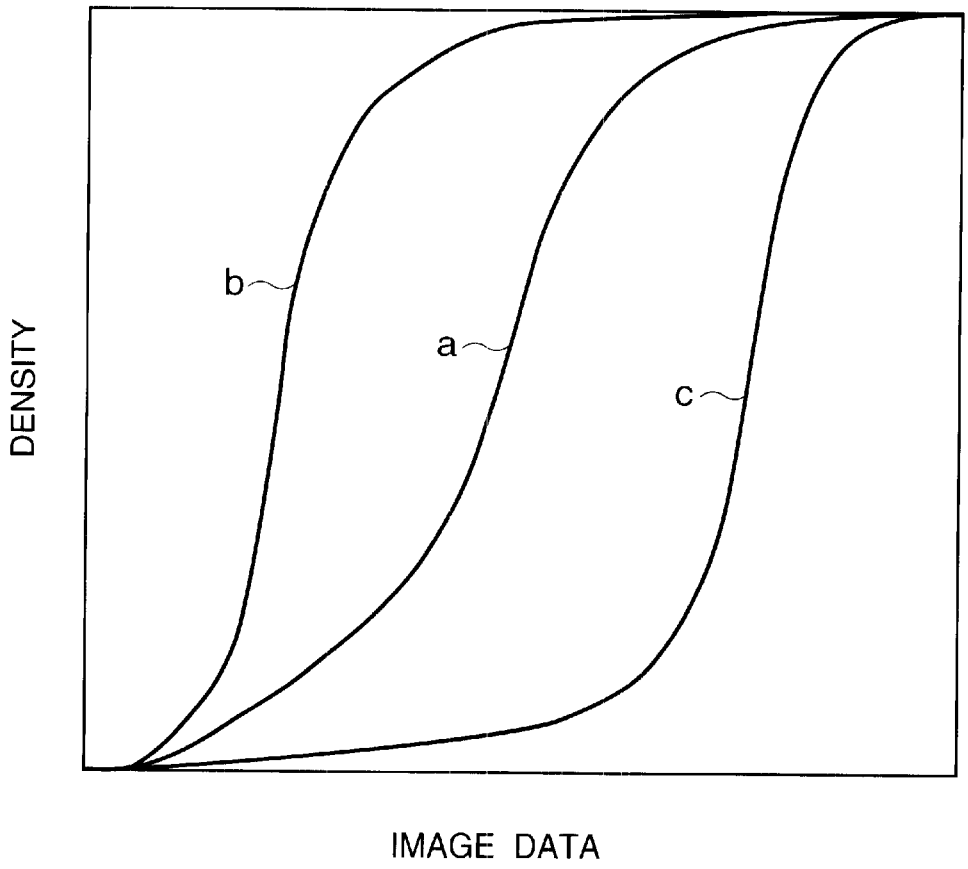
FIG. 10 is a graph for explaining change in the gradation property of the image in the electrophotographic image forming apparatus.

That is to say, in the electrophotographic color image forming apparatus, not only the above-mentioned image density but also its gradation property are varied with the number of image formation operations. For example, under a certain environment, although the gradation property of pixels normally becomes a form shown by a curve a in FIG. 10, when the number of image formation operations is increased, the gradation property as shown by a curve b is reached. Further, due to any abnormality, the gradation property shown by a curve c may be reached.

If the gradation property shown by the curve b or c is reached, the desired gradation property cannot be obtained whichever gradation correction property is used, thereby making a high quality image impossible. That is to say, if the gradation property is changed greatly, even when the photosensitive drums 1Y to 1Bk and the developer remaining amounts do not reach their service lives, it is regarded that the service lives of the process cartridges 100Y to 100Bk for which the high quality image can be expected are expired. Further, it was found that the change in gradation property shown in FIG. 10 occurs under other environments.

Thus, in the illustrated embodiment, in addition to the number of image formation operations and the developer remaining amount which are conventionally used for indicating the cartridge consumed amount, combinations of image data (SY1 to SY7, SM1 to SM7, SC1 to SC7 and SBk1 to SBk7) and image density data (D'Y1 to D'Y7, D'M1 to D'M7, D'C1 to D'C7 and D'Bk1 to D'Bk7) obtained from gradation control are written in the memories 36Y to 36Bk provided in the process cartridges 100Y to 100Bk, respectively so that the service lives of the process cartridges 100Y to 100Bk can be detected more correctly. In the illustrated embodiment, further, environment data Env under which the gradation control was effected is written in the memories 36Y to 36Bk.

Figure 11:
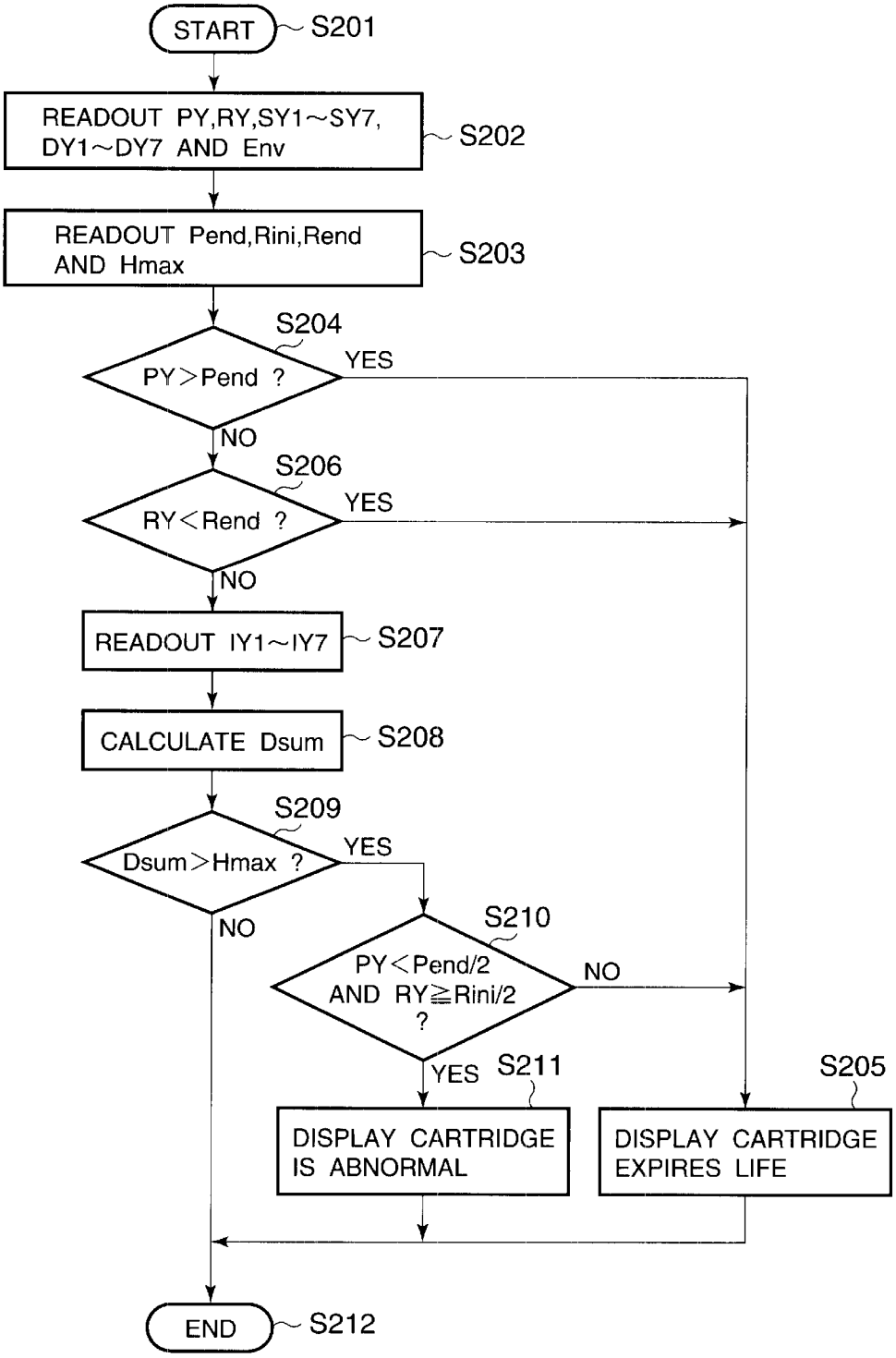
FIG. 11 is a flow chart for explaining another embodiment of the life detection of a cartridge in accordance with the present invention.

Next, as an example of a cartridge life detecting operation according to the illustrated embodiment, detection of a life of the process cartridge 100Y of the yellow (Y) image forming portion according to the illustrated embodiment will be explained with reference to FIG. 11.

When the detection of the life of the process cartridge is started at a predetermined timing such as the turning ON of the power supply of the printer A or the completion of the image formation (step S201), first of all, the CPU 30 of the control portion D reads out the number of image formation operations PY, the developer remaining amount RY, image data SY1 to SY7 of patches used in the gradation control and corresponding measured density data D'Y1 to D'Y7, and the environment data Env under which the gradation control was effected regarding the process cartridge 100Y from the memory 36Y of the process cartridge 100Y (step S202).

Then, the CPU 30 reads out a life value Pend of the number of image formation operations, an initial developer amount Rini, a life value Rend of the developer remaining amount and an upper limit value Hmax of a changed amount of the gradation property previously stored in the ROM 31 of the control portion D (step S203).

Then, the CPU 30 judges whether the number of image formation operations PY exceeds the value Pend (step S204). If exceeded, the fact that the life of the cartridge is expired is displayed on the display panel 40 provided on the main body of the image forming apparatus (step S205).

In the step S204, if it is judged that PY does not exceed Pend, then, the CPU 30 judges whether the developer remaining amount RY is decreased below the value Rend (step S206). If decreased below the value, the fact that the life of the cartridge is expired is displayed on the display panel 40 (step S205).

In the step S206, if it is judged that RY is not decreased below Rend, the CPU 30 reads out density data IY1 to IY7 corresponding to the patch image data SY1 to SY7 guessed from the environment data Env under which the gradation control was effected and the number of image formation operations PY from the ROM 31 (step S207). Then, the CPU 30 calculates the sum (Dsum) of absolute values of differences between the patch measured densities D'Y1 to D'Y7 and the guessed densities IY1 to IY7 as follows (step S208):

$$Dsum=|D'Y1-IY1|+|D'Y2-IY2|+\ldots+|D'Y7-IY7|$$

Then, it is judged whether Dsum exceeds Hmax (step S209). If not exceeded, since the life of the cartridge is not expired, the life detection is ended (step S212).

On the other hand, in the step S209, it is judged that Dsum exceeds Hmax, similar to the first embodiment, in order to judge whether the deterioration of the cartridge is abnormally fast or not, it is judged whether PY does not reach Pend/2 or whether RY is not less than Rini/2 (step S210). If PY does not reach Pend/2 and RY is greater than Rini/2, the fact that the cartridge may be abnormal is displayed on the display panel 40 (step S211). If otherwise, the fact that the life of the cartridge is expired is displayed on the display panel (step S205). In this way, the detection of the life of the cartridge is ended (step S212).

Incidentally, similar to the first embodiment, threshold values of the number of image formation operations and the developer remaining amount by which the abnormality is judged in the step S210 may be set appropriately in accordance with the property of the cartridge.

While the cartridge-life detection regarding the process cartridge 100Y in the yellow image forming portion was explained, similarly, cartridge-life detection of other color image forming portions can be effected successively or simultaneously.

Incidentally, in the forwarding of the process cartridge 100Y to 100Bk, in the memories 36Y to 36Bk thereof, normal temperature/humidity (25° C., 60%) may be stored as the environment data, and values selected based on the gradation property derived from the environment data and the number of image formation operations 0 are subjected to default and are stored as the gradation property data. Further, the timings for writing various data in the memories 36Y to 36Bk are not limited specifically, but, it is preferable that the gradation property data (IY1 to IY7, IM1 to IM7, IC1 to IC7 and IBk1 to IBk7) (D'Y1 to D'Y7, D'M1 to D'M7, D'C1 to D'C7 and D'Bk1 to D'BK7) and the environment data (Env) be written immediately after the gradation control and the numbers of image formation operations (PY to PBk) and the developer remaining amounts (RY to RBk) be written immediately after image formation.

Further, in the illustrated embodiment, while the gradation property was used, a gradation correction property derived from the gradation property may be used.

As mentioned above, also in this embodiment, the service lives of the process cartridges 100Y to 100Bk can always be detected correctly.

In the above explanation, the embodiments of the present invention were described. As can be understood from the above-mentioned embodiments, the information obtained from the image density control is an index for indicating an image forming ability and is very useful information for ascertaining the life of the cartridge. Accordingly, it can be understood that it is very effective to further effect the correction based on the information obtained from the image-density control after the life of the cartridge is checked by using the number of image formation operations and developer remaining amount.

Further, according to the present invention, as explained in connection with the embodiments, by storing the developing biases obtained from the Dmax control and the gradation properties obtained from the gradation control as image-density-control information in the memory means of the cartridges, such information can effectively be used to guess the cause of trouble and grasp market information. Further, as mentioned above, according to the present invention, by storing the cartridge-consumed-amount information and the information obtained from the image density control in the memory means of each cartridge, even if the cartridge is dismounted from the image forming apparatus before its life is not expired, when the dismounted cartridge is again mounted on the image forming apparatus later, the correct cartridge life detection of the cartridge can be effected promptly.

Incidentally, the image forming apparatus is not limited to the printer A according to each of the embodiments, but, various alterations can be made within the scope of the invention. For example, in place of the environment data and the developing bias or the gradation property, developing bias or gradation property standardized on the basis of the environment data may be stored in the memory means of the cartridge. Further, as the cartridge-consumed-amount information, in place of the developer remaining amount, the pixel count may be stored as the developer amount or both the developer remaining amount and the pixel count may be stored, and, as the amount indicating the consumed amount of the photosensitive drum, in place of the number of image formation operations, the number of revolutions of the photosensitive drum or charging time period may be used. Further, so long as memory capacity of the memory means has a sufficient vacant space, both the developing bias data obtained from the Dmax control and the gradation property data obtained from the gradation control may be stored in the memory means so that the life of the cartridge can be detected by a combination of both data. Further, the image density control and the life detection may be effected in the video controller, in place of the control portion of the printer engine.

Further, it should be understood that the present invention can be applied to a known color image forming apparatus and monochromatic image forming apparatus of intermediate transfer member type. In addition, in the above-mentioned embodiments, while an example that the cartridge detachably mountable on the image forming apparatus is the process cartridge integrally including the photosensitive drum unit and the developing unit, the number of image formation operations indicating the consumed amount of the photosensitive drum and the developer amount indicating the consumed amount of the developing unit are used, was explained. However, the present invention is not limited to such an example, but, for example, only the developer amount may be used as the cartridge-consumed-amount information. Further, for example, in case of a cartridge in which the photosensitive drum unit and the developing unit can detachably be mounted on the main body of the image forming apparatus independently, by using the developer amount as the developing-cartridge-consumed-amount information and by storing at least the cartridge-consumed-amount information and the image-density-control information in memory means provided in the developing cartridge, the life of the developing cartridge can be detected correctly, similar to the above-mentioned embodiments.

Further, in the above-mentioned embodiments, while an example that the information such as the life value Pend of the number of image formation operations, the initial developer amount Rini, the life value Rend of the developer remaining amount and the upper limit value Hmax of the gradation property are previously stored in the ROM 31 of the control portion D was explained, such information may be stored in any memory means of the cartridge. With this arrangement, in corresponding to minute design modification of the cartridge, the image density control suitable for such cartridge can be effected to detect the life thereof correctly.

Further, in the above-mentioned embodiments, while an example that information warning about the life of the cartridge or information warning about the abnormality of the cartridge is displayed on the display panel provided on the main body of the image forming apparatus was explained, the present invention is not limited to such an example. For example, such information can be displayed on display means of equipment connected to the main body of the image forming apparatus for inter-communication therebetween, such as a display of a host computer connected to the main body of the image forming apparatus for inter-communication therebetween. In addition, the warning may be effected by an alarming sound or be recorded on a recording medium and outputted.

The present invention is not limited to the above-mentioned embodiments, and various modifications and alterations can be made within the scope of the invention.

What is claimed is:

1. An image forming apparatus comprising:

a unit detachably mountable on said image forming apparatus, said unit having developing means for developing a latent image formed on an image bearing member;

developing bias setting means for setting a developing bias so that an image developed by said developing means maintains a predetermined density; and life determining means for determining the life of said unit in accordance with the developing bias set by said developing bias setting means and a reference bias, wherein the reference bias is set in accordance with data relating to the amount said unit is used.

2. An image forming apparatus according to claim 1, wherein said life judging means judges that the life of said unit is expired when the developing bias set by said developing bias setting means is smaller than the reference bias.

3. An image forming apparatus according to claim 2, further comprising environment detecting means for detecting an environment under which said apparatus is used, wherein the reference bias is set in accordance with an environment data detected by said environment detecting means and the data relating to the amount said unit is used.

4. An image forming apparatus according to claim 1, further comprising second life determining means for determining the life of said unit based on the data relating to a amount said unit is used.

5. An image forming apparatus according to claim 1, wherein the data relating to the amount said unit is used is the number of prints printed by using said unit.

6. An image forming apparatus according to claim 1, wherein the data relating to the amount said unit is used is the amount of developer in said unit.

7. A unit detachably mountable on an image forming apparatus including developing bias setting means for setting a developing bias so that an image developed by a developing means maintains a predetermined density, comprising:

developing means for developing a latent image formed on an image bearing member; and a memory, wherein said memory stores data of the developing bias set by said developing bias setting means.

8. A unit according to claim 7, wherein said memory further stores data representing the number of prints printed by using said unit and environment data.

9. A unit according to claim 7 or 8, wherein said memory further stores data representing the amount of developer in said unit.

10. A unit according to claim 7, further comprising at least one of an image bearing member, charging means for charging said image bearing member and cleaning means for cleaning said image bearing member.

11. An image forming apparatus comprising:

a unit detachably mountable on said image forming apparatus, said unit having developing means for developing a latent image formed on an image bearing member; and life determining means for determining the life of said unit in accordance with an image density of a test pattern formed by said developing means and a reference density;

wherein the reference density is set in accordance with data relating to the amount said unit is used.

12. An image forming apparatus according to claim 11, wherein said life determining means determines that the life of said unit is expired when the image density of the test pattern is higher than the reference density.

13. An image forming apparatus according to claim 12, further comprising environment detecting means for detecting the environment under which said apparatus is used, wherein the reference density is set in accordance with an environment data detected by said environment detecting means and the data relating to the amount said unit is used.

14. An image forming apparatus according to claim 11, wherein the test pattern is formed by forming a plurality of test latent images with a predetermined plurality of test image data having different image densities and developing the plurality of test latent images with a constant developing bias.

15. An image forming apparatus according to claim 11, further comprising second life determining means for determining the life of said unit based on an information regarding the amount said unit is used.

16. An image forming apparatus according to claim 15, wherein the information regarding the amount said unit is used is information regarding the number of prints.

17. An image forming apparatus according to claim 15, wherein the information regarding the amount said unit is used is information regarding the amount of developer in said unit.

18. A unit detachably mountable on an image forming apparatus, comprising:

developing means for developing a latent image formed on an image bearing member; and a memory;

wherein said memory stores image density data when a gradation control is effected.

19. A unit according to claim 18, wherein said memory further stores data representing the number of prints and environment data.

20. A unit according to claim 18 or 19, wherein said memory further stores the amount of developer in said unit.

21. A unit according to claim 18, further comprising at least one of an image bearing member, charging means for charging said image bearing member and cleaning means for cleaning said image bearing member.

* * * * *

UNITED STATES PATENT AND TRADEMARK OFFICE

CERTIFICATE OF CORRECTION

PATENT NO. : 6,473,572 B1
DATED : October 29, 2002
INVENTOR(S) : Uchiyama et al.

It is certified that error appears in the above-identified patent and that said Letters Patent is hereby corrected as shown below:

Column 1,
Lines 37 and 40, “can” should read -- can be --.

Column 3,
Line 35, “can” should read -- can be --.

Column 4,
Line 49, “can” should read -- can be --.

Column 6,
Line 34, “an” should read -- a --.

Column 7,
Line 30, “apparats” should read -- apparatus --.

Column 9,
Line 50, “a” should read -- an --.

Column 11,
Line 35, after “above-mentioned” “the” (first occurrence) should be deleted.

Column 16,
Line 66, “judging” should read -- determining -- and “judges” should read -- determines --.

Column 17,
Line 9, “a” should read -- the --.
Line 45, “;” should read -- , --.

Signed and Sealed this

Sixth Day of May, 2003

JAMES E. ROGAN
*Director of the United States Patent and Trademark Office*